United States Patent [19]

Borzoni

[11] Patent Number: 4,604,602

[45] Date of Patent: Aug. 5, 1986

[54] PLUG-IN FUSE ASSEMBLY WITH STACKABLE HOUSING

[75] Inventor: John Borzoni, Indian Rocks Beach, Fla.

[73] Assignee: Littelfuse, Inc., Des Plaines, Ill.

[21] Appl. No.: 722,596

[22] Filed: Apr. 16, 1985

Related U.S. Application Data

[63] Continuation-in-part of Ser. No. 640,841, Aug. 17, 1984.

[51] Int. Cl.[4] ..... H01H 85/16

[52] U.S. Cl. ..... 337/264; 337/198; 337/255

[58] Field of Search ..... 337/264, 255, 256, 263, 337/198, 283

[56] References Cited

U.S. PATENT DOCUMENTS 4,504,816 3/1985 Viola et al. ..... 337/264

*Primary Examiner*—Harold Broome

*Attorney, Agent, or Firm*—Russell E. Hattis; Stephen R. Arnold

[57] ABSTRACT

A plug-in fuse assembly comprising a housing made of insulating material and includes upwardly extending side walls bridged by upwardly extending end walls, and a conductive plug-in fuse element secured in the housing. The conductive plug-in fuse element has parallel confronting terminals projecting downwardly from the bottom of the housing. The housing end and side walls uniquely have outermost vertical coplanar wall surfaces, preferably at the sides and top margins thereof, which are parallel to the housing sides involved and to the corresponding outermost vertical coplanar wall surfaces on the opposite end or side of the housing. The outermost vertical coplanar wall surfaces are adapted to engage the complementary outermost vertical wall surfaces of an identical plug-in fuse assembly placed with the identical end-to-end or side-by-side orientation besides it. The outermost vertical coplanar wall surfaces of each wall occupy only a fractional part of the outer exposed surfaces of the housing end wall involved.

14 Claims, 14 Drawing Figures

FIG. 5
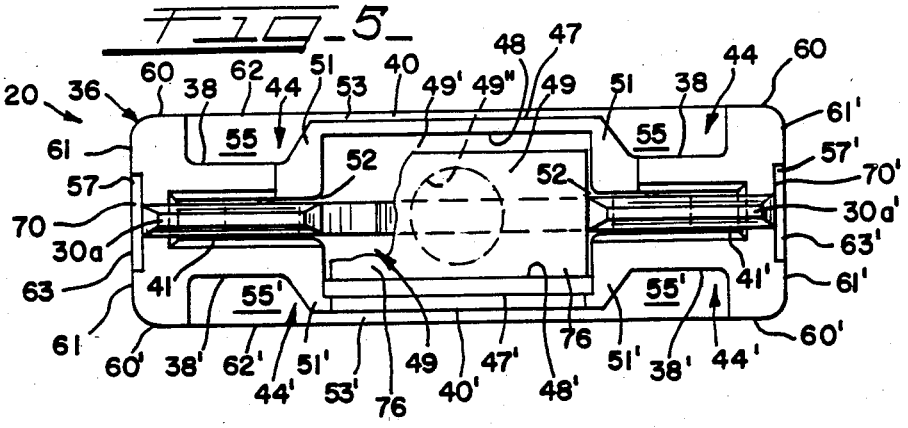
FIG. 6
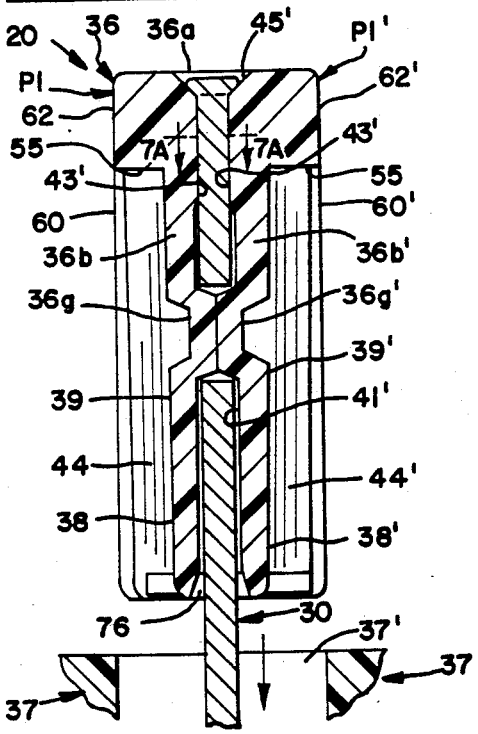
FIG. 7
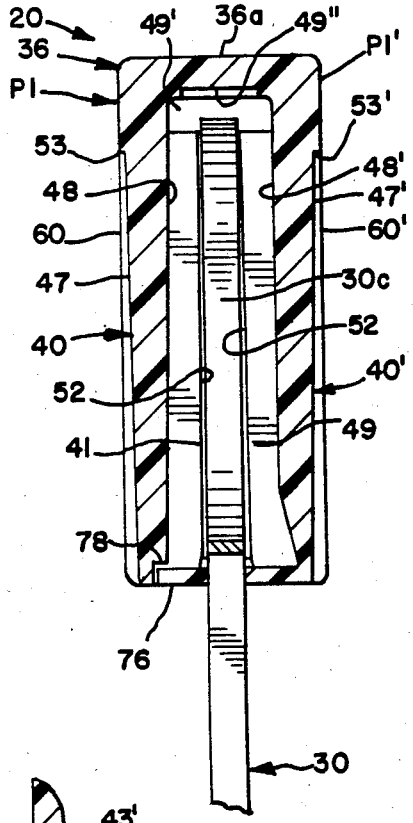
FIG. 7B
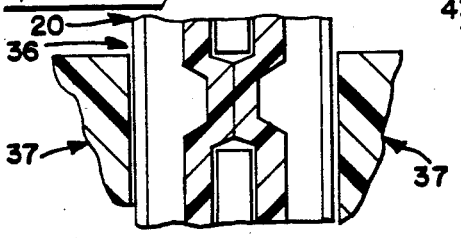
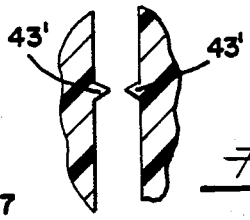
FIG. 7A FIG. 9A
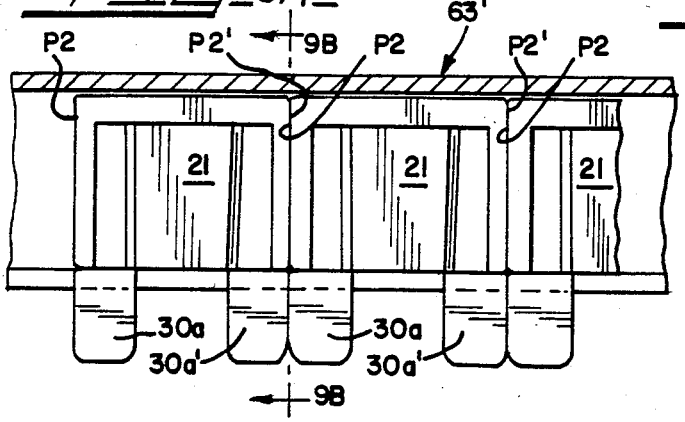
FIG. 9B
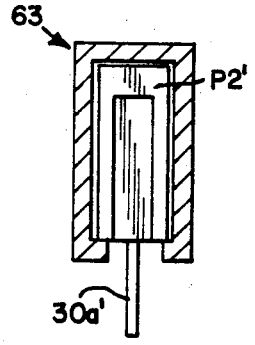
FIG. 8
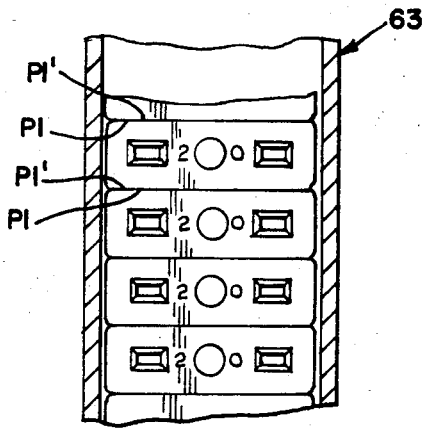
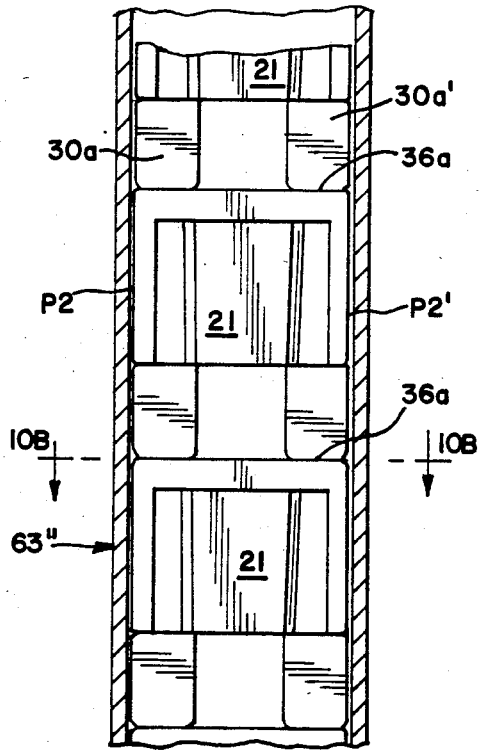
FIG. 10A
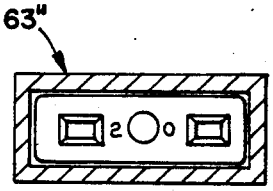
FIG. 10B

PLUG-IN FUSE ASSEMBLY WITH STACKABLE HOUSING

RELATED APPLICATION

The present application is a continuation-in-part of application Ser. No. 640,841, filed Aug. 17, 1984 and entitled Plug-In Fuse Assembly.

TECHNICAL FIELD OF INVENTION

Briefly, this invention relates to improvements involving a plug-in fuse assembly like that disclosed in U.S. Pat. Nos. 3,909,767, 3,962,782, 4,099,320, and other patents. While these fuses were originally developed and still have their most important use as automobile fuses, they have other applications. More specifically, the invention relates to a unique fuse of the type referred to which can be readily stacked in feeding hoppers end to end, side to side and/or one above the other. This enables the fuses to be automatically fed in hoppers at the highest possible speeds to fuse block insertion locations by the automobile manufacturers.

BACKGROUND OF THE INVENTION

The fuse of the invention and those disclosed in these patents preferably, but not necessarily, comprises an all metal plug-in fuse element including a pair of laterally spaced juxtaposed, parallel terminal blade portions to be received by pressure clip terminals in a mounting panel or fuse block, current-carrying extensions at the inner end portions of the pair of terminal bladeportions and a fuse link portion of relatively small cross-sectional area extending transversely between the current-carrying extensions. The shape, placement and/or size and thickness of the fuse link determines the current rating of the fuse.

The plug-in fuse element is anchored in a housing which most advantageously is a molded body of transparent material from which the terminal blade portions project downwardly in the exemplary assumed orientation of the fuse. The fuse housing preferably has relatively closely spaced side walls bridged by narrow end walls and a narrow outer top or head wall. The all metal plug-in fuse element may be anchored in place in the housing by staking portions of the housing side walls into apertures in the terminal blade current-carrying extensions of the plug-in fuse element. Upper portions of the housing preferably overhang the rest of the housing to provide convenient, centered, gripping surfaces at the side and ends of the housing, so that any selected plug-in fuse assembly in a fuse block can be readily grasped for removal from the a fuse block, despite small clearances between adjacently mounted plug-in fuse assemblies.

Heretofore, the housings of the fuses were designed in a manner which made it difficult to reliably stack the fuses in hoppers and the like and deliver the same at the most desired high speeds to the location of the automobile fuse blocks where the fuses are machine inserted into terminal-receiving cavities in the fuse block. Depending upon circumstances, it may be desirable to stack the fuses in end-to-end, side-by-side or one above the other relationship in the hopper. The feeding speed and reliability of the insertion operation depends upon the stability of the stacked fuses within the hopper. In the fuse housings heretofore used, the side, end and top walls of the fuse housing were so shaped that when they were stacked in any of these relationships, they could wobble, so that they did not have a sufficiently fixed or stable orientation desired for very high speed feeding thereof. The present invention provides a unique fuse housing construction which provides a stable stacking of the fuses preferably in any one of three different stacking relationships described, although the broader aspects thereof envision a housing design which does so in either end-to end or side-by-side relationship.

SUMMARY OF THE INVENTION

In the fuse descriptions and claims to follow, for purposes of convenience and simplicity, the fuse assemblies will be assumed to have an orientation where the terminal blade portions of the all metal plug-in fuse element extend downwardly from the fuse housing. However, the fuse assembly may have any orientation when actually used.

In accordance with one of the features of the invention and assumed fuse orientation, the fuse assembly housing, preferably molded of synthetic plastic material, has side walls with outermost vertical flat surfaces which are parallel to each other and the housing sides so that they can stably abut the corresponding opposed outermost vertical flat surfaces of the side walls of the housings of identical fuse assemblies having identical orientations beside it in a hopper with a rectangular cross section. Most of the exposed surface areas of the side walls are recessed within these vertical flat surfaces and the walls which form these recessed portions taper in the direction which facilitates separation of the mold parts which form them.

When these housings are molded, the mold parts generally include an upper mold part which usually terminates at the gripping surface plane near the top of the housing, and a bottom mold part which mates with the bottom portion of the upper mold part. These two mold parts define the various connecting cavities of the housing into which the synthetic plastic material will flow during the molding process. It is known that the ease and the desired high speed with which the upper and lower mold parts can be separated to free the molded housing is facilitated if the opposed interfacial surface areas between the mold parts and molded housing are inclined to the vertical toward one another in the direction of mold separation (i.e. that is the downward direction for the lower mold part). The degree of taper of these surfaces can be so small as to be visibly imperceptible. However, to enable adjacent fuses to be stably stacked side by side within a hopper, the abutting outermost surfaces of the side walls of the housings of adjacent fuses to be stacked in side-by-side relationship in a hopper must not incline to the vertical and must occupy a sufficient horizontal vertical extent to prevent relative movement between abutting fuse housings.

A specific, but not necessary, aspect of the invention is that the extent and location of these outermost vertical flat surfaces should be such as not to interrupt the desired centered finger or tool gripping surfaces needed for ease of fuse removal from the fuse block in which the fuse assembly is mounted. To this end, the outermost flat vertical surfaces of the side walls of the housing described are preferably located along margins of the side walls, such as along narrow vertical bands at the ends of each housing side wall thereof and along a horizontal band at the top of the housing, where they form inverted U-shaped projections. The rest of the side walls are recessed within these inverted U-shaped projections. The upper, horizontal legs of these projections form at the bottoms thereof centrally located, downwardly facing finger or tool gripping surfaces on the opposite sides of the housing.

To minimize the amount of molding material needed, provide a more constant and even shrinkage, and reduce mold part costs, it is desirable that the interfitting mold parts form a housing with a fairly constant wall thickness. Since it is known to be desirable to space the fuse link from the housing side walls, with the outer ends of the housing side walls fairly closely enveloping the current-carrying extensions of the terminal blades, the central portion of the housing side walls must bulge out opposite the fuse link if the side wall thickness is to remain fairly constant. In the broadest aspect of the invention, these centered bulging portions of the side walls could be part of the outermost flat vertical surfaces described, and would then not fall along inverted U-shaped paths. Also, the areas occupied by such centered bulging portions of the housing side walls would undesirably increase the non-tapered areas of the mold parts and would eliminate the desired centered finger or tool gripping surfaces at the sides of the housing. Thus, these bulging side walls are preferably located within i.e., inwardly displaced from the vertical planes of the inverted U-shaped side wall projections described and are tapered in a downward direction. The vertical legs of these inverted U-shaped projections are separated from the centered bulging portions of the side walls by deeply recessed portions of the side walls to keep the wall thickness fairly constant.

In accordance with another feature of the invention, to provide for a most stable end-to-end or side-by-side stacking of the fuses within a hopper of rectangular cross section, the end walls of the housing are designed like the side walls described to provide narrow bands of outermost flat vertical surfaces. These outermost flat vertical surfaces of the end walls also preferably follow an inverted U-shaped pattern and so are found in narrow bands at the side margins and top of the housing and enclose tapered recesses which form near the top of the housing centered, downwardly facing finger or tool gripping surfaces. In the most preferred form of the invention, the side and upper legs of the inverted U-shaped projection of the side and end walls of the housing merge and intersect at the corners of the housing. The outermost flat vertical surface of the side and end walls thus give the fuse assembly housing a rectangular horizontal profile which can fit within a slightly larger correspondly shaped rectangular cavity in a fuse block and be guided by the walls thereof into its final fully-plugged condition. The fuse block cavity has terminal blade-receiving terminals mounted deeply within each cavity, which is slightly larger than the rectangular horizontal profile of the fuse housing.

The horizontal and vertical legs of the inverted U-shaped projections of the housing side and end walls described provide good stacking stability also when the fuses are stacked one on top of the other within a hopper with a stacking channel of rectangular cross section.

Additionally, as an aid in guiding each fuse assembly into a cavity of a fuse block and to make the fuse assembly more compact overall, the outer margins of the terminal blades which have tapered ends are in vertical alignment with the outermost vertical flat surfaces of the housing end walls.

It should now be apparent that the fuse assembly is initially guided into a fuse block cavity by the tapered ends of the terminal blades, since the outer margins of the terminal blades are aligned with the outermost flat vertical surfaces of the fuse housing end walls. Thereafter, the fuse assembly is smoothly guided for movement fully into the fuse block cavity which encloses both terminal blades and the lower portion of the fuse assembly housing. The upper end thereof remains above the fuse block cavity where the downwardly facing gripping surfaces are exposed to aid in removal of the fuse from the fuse block. This unique in-line relationship between the housing end walls and terminal blades contrasts with prior art fuse designs where the terminal blades were located within the outer margins of the fuse housing end walls, and thus could not guide the fuse assembly into a fuse cavity which is to closely envelop the fuse housing.

The above and other features and advantages of the invention will become apparent upon making reference to the specification and claims to follow and the drawings.

DESCRIPTION OF THE DRAWINGS

FIG. 5 is an enlarged bottom view of the plug-in fuse assembly of FIG. 1;

FIG. 6 is an enlarged transverse vertical sectional view through the plug-in fuse assembly shown in FIG. 4, taken along section line 6—6 thereof and includes in fragmentary section the defining walls of a fuse blank cavity into which the fuse assembly is to be placed;

FIG. 7 is an enlarged vertical transverse sectional view through the center portion of the plug-in fuse assembly shown in FIG. 4, taken along section lines 7—7 thereof;

FIG. 7A is an enlarged fragmentary horizontal sectional view through FIG. 6, taken along section lines 7A—7A thereof prior to the insertion of the plug-in fuse element;

FIG. 7B is a fragmentary enlarged sectional view through a fuse block cavity with the fuse of the invention fully mounted therein, and showing the top of the fuse assembly projecting above the fuse block, the clearance spaces shown, as in other figures, being exaggerated for drawing convenience;

FIG. 7B is a fragmentary, enlarged sectional view through a fuse blank cavity and fuse blank mounted therein showing the top of the fuse assembly projecting above the fuse block;

FIG. 8 is a sectional view through a hopper containing fuses of the present invention stably stacked in side-by-side relationship;

FIG. 9A is a view through a hopper showing the fuses of the invention stacked in end-to-end relationship;

FIG. 9B is a transverse section through the hopper of FIG. 9A taken along section line 9B—9B;

FIG. 10A is a view through a hopper wherein the fuses of the invention are stacked so that the terminal blades of one fuse engage the flat outer wall of the housing of the adjacent fuse assembly; and FIG. 10B is a sectional view through the hopper of FIG. 10A taken along section line 10B—10B thereof.

DESCRIPTION OF THE PREFERRED EMBODIMENT OF THE INVENTION

Figure 1:
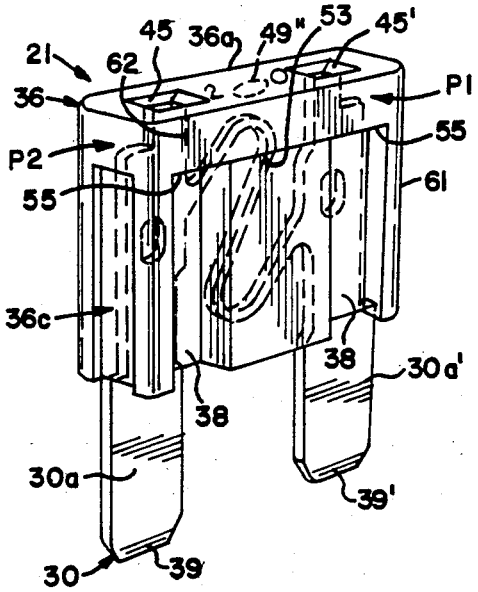
FIG. 1 is a perspective view of a preferred form of the plug-in fuse assembly of the invention.

Referring now more particularly to FIGS. 1–4, there is shown a preferred plug-in fuse assembly 21 of the invention. This assembly is made of only two component parts, namely an all fuse metal plug-in fuse element 30, which may be a single stamping from a strip of fuse metal, and a housing 36 which most advantageously is a single piece of transparent synthetic plastic molded part defining a space therein into which portions of the plug-in fuse element 30 extend and are secured in any suitable way, but most preferably by a cold staking and ultrasonic welding operation.

For purposes of simplicity of description and claiming, the fuse assembly will be assumed to have an orientation as shown where the terminal blade portions 30*a*–30*a*′ of the plug-in fuse element 30 extend downwardly from the housing 36. However, the fuse assembly may have any orientation. Most commonly, it plugs into a fuse block (not shown) which has a vertical fuse monitoring wall with fuse-receiving openings facing horizontally so that the terminal blades extend horizontally rather than vertically as shown.

The terminal blade portions 30*a*–30*a*′ are plated with a highly conductive metal like tin and extend downwardly in spaced parallel juxtaposed relationship from the inner or bottom margin of the housing 36. The ends of the terminal blade portions 30*a*–30*a*′ of the plug-in fuse element are most advantageously tapered at 39–39′ to form pointed end portions which readily guide the entire fuse assembly into place within a rectangular fuse block cavity 37′ of a fuse block 37 having a length (only slightly) larger (e.g. by about 1/32″) than the distance between the outermost vertical margins of the terminal blade portions 30*a*–30*a*′.

The terminal blade portions 30*a*–30*a*′ have current-carrying extensions 30*b*–30*b*′ which are also preferably tin plated, and the outer end portions thereof form probe-receiving tabs 30*d*–30*d*′. The current-carrying extensions 30*b*–30*b*′ are interconnected by an unplated or plated S-shaped fuse link portion 30*c* which is shown narrower in width than the other current-carrying portions of the plug-in fuse element. The current-carrying capacity of the fuse link portion 30*c* may be varied by varying its location, and configuration, and its width, length and thickness dimensions. However, the basic configuration of the terminal blade and current-carrying extension portions are standardized for the different configurations used in the fuse link portions, so that common mechanical staking and ultrasonic welding equipment can be used for all fuses. All of the various parts of the plug-in fuse element are shown substantially in coplanar relation. To anchor the plug-in fuse element 30 within the housing 36, staking or anchoring apertures 30*e*–30*e* ′ are formed in the current-carrying extensions 30*b*–30*b*′ to receive anchoring projections 36*g*–36*g*′ formed in the housing side walls 36*b*–36*b*′.

The confronting outer edges of the terminal blade portions 30*a*–30*a*′ of the fuse assembly merge with inwardly offset outer vertical margins 30*f*–30*f*′ (FIG. 2) of the current-carrying extensions 30*b*–30*b*′. The terminal blade portions 30*a*–30*a*′ are preferably of a consistent width up to the point where that portion of the plug-in fuse element passes into the housing 36. These inwardly offset outer vertical margins form upwardly facing stop shoulders 30*m*–30*m*′ and clearance spaces above for the narrow end walls 36*c*–36*c*′ of the housing 36. These end walls in prior art fuse designs projected substantially horizontally beyond the vertical outer margins of the current-carrying extensions. In the fuse illustrated, the housing end walls are in substantially vertical alignment with the outer vertical margins of the terminal blade portions 30*a*–30*a*′ of the plug-in fuse element 30 to make the fuse more compact and provide a smooth guided movement of the fuse assembly in the rectangular cavity 37′ in the fuse block 37.

The fuse assembly illustrated in the drawings may be made exceedingly small (e.g. the fuse width is less than ½ of an inch). In such case, the problem of punching the very small fuse links make. desirable configurations not used in much larger fuses to which the present invention also applies. In such small fuses, inwardly offset confronting margins 30*j*–30*j*′ of the current-carrying extensions 30*b*–30*b*′ of the terminal blade portions 30*a*–30*a*′ starting immediately above the terminal blade portions are provided to increase the spacing between the lower loop of the fuse link portion 30*c* and the left current-carrying extension 30*b*. This increases the width and mechanical strength of the portion of the manufacturing punch used to punch out this portion of the all metal plug-in fuse element 30 from a strip of fuse metal. The punch needed to punch out that portion of the plug-in fuse element to the left of the fuse link portion 30*c* shown in FIG. 4 becomes especially weak if the punch becomes unduly narrow at the points thereof spaced substantially from the upper end thereof. For similar reasons, it is desirable to maximize the spacing between the upper loop of the fuse link portion 30*c* and the inner vertical margin of the upper end of the right current-carrying extension 30*b*′.

While the housing 36 could be made in separate parts snappable or otherwise secured together to form a single piece at the time the housing is assembled, the housing is most advantageously a single piece integral molded part as shown where the various walls thereof are, for the most part, of similar thickness. It preferably has, in addition to the relatively wide side walls 36*b*–36*b*′ (FIGS. 1, 6, and 7), the flat horizontal top wall 36*a*, and narrow end walls 36*c*–36*c*′. The current rating of the plug-in fuse assembly is indicated by indicia on the flat horizontal top wall 36*a* of the housing (see "2" to left of dashed circle 49″ and "0" to the right of the dashed circle in FIG. 3) and by a distinctive housing color. Each side wall has narrow deeply recessed end portions 38—38 or 38′–38′ on opposite sides of a less deeply recessed wide central bulging portion 40 or 40′. As best shown in FIGS. 5 and 6, the deeply recessed portions 38–38′ at each end of the housing are closely spaced and define therebetween a narrow upwardly tapering passageway 41 or 41′ which closely receives one of the current-carrying extensions 30*b* or 30*b*′ of the all metal plug-in fuse element 30. These extensions are held initially within the housing during the assembly process by confronting ribs 43—43 and 43′–43′ FIGS. 6 and 7A) projecting from the housing interior in the upper portions of the tapered passageway 41 or 41′. Each passageway 41 or 41′ terminates in an outwardly flaring opening 45 or 45′ at the top of the housing, which opening exposes the peened upper end of the associated probe-receiving tab 30*d* or 30*d*'. FIG. 6 shows that the deeply recessed side wall portions 38–38' are downwardly tapered by virtue of their downwardly and inwardly inclining outer surface 39–39' and define recesses 44–44' on the outside of the housing. The wall portions 38–38' and the other recessed wall portions of the housing taper downwardly so that a lower mold part (not shown) which forms the side walls 36*b*–36*b*' and the rest of the housing below the uppermost part thereof can be readily separated from the molded housing by relative vertical downward movement thereof.

The central bulging side wall portions 40–40' have opposite surfaces 47–48 and 47'–48' inclining downwardly toward each other so that the bulging side wall portions taper in thickness in a downward direction as indicated, to facilitate mold separation. The inner surfaces 48–48' of these wall portions are spaced relatively appreciably from the fuse link 30*c* so that they have minimum heat sinking effect on the fuse link. They define a central upwardly tapering passageway 49 communicating through narrow slots 52–52' (FIG. 5) with the current-carrying extension-receiving passageways 41–41'. The central passageway terminates at the top thereof in a generally concave upper portion 49' having an upwardly projecting cylindrical extension 49'' which thins the top wall 36*a* of the housing at this point to form a circular area of maximum transparency through which part of the fuse link portion 30*c* of the all metal plug-in fuse element 30 may be more readily visible.

Figure 2:
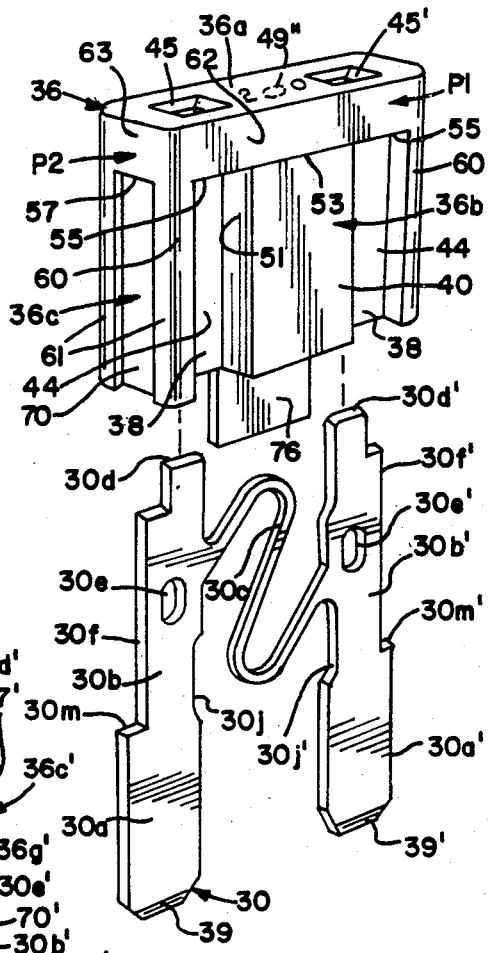
FIG. 2 is an exploded view of the housing and plug-in fuse element of FIG. 1 before they are assembled.

The bulging side wall portions 40–40' merge with the most deeply recessed end side wall portions 38—38 and 38'—38' in slightly outwardly inclining bridging wall portions 51—51 and 51'–51' (FIGS. 2 and 5). The bulging side wall portions 40–40' terminate below in the top wall 36*a* of the housing and within the margins thereof at horizontal downwardly-facing finger or tool gripping surfaces 53–53' on opposite sides of the housing (FIG. 7). The surfaces 53–53' are in alignment with the horizontal downwardly-facing surfaces 55—55 at the top of the deep recesses 44—44 and 44'—44' (FIG. 6).

Figure 4:
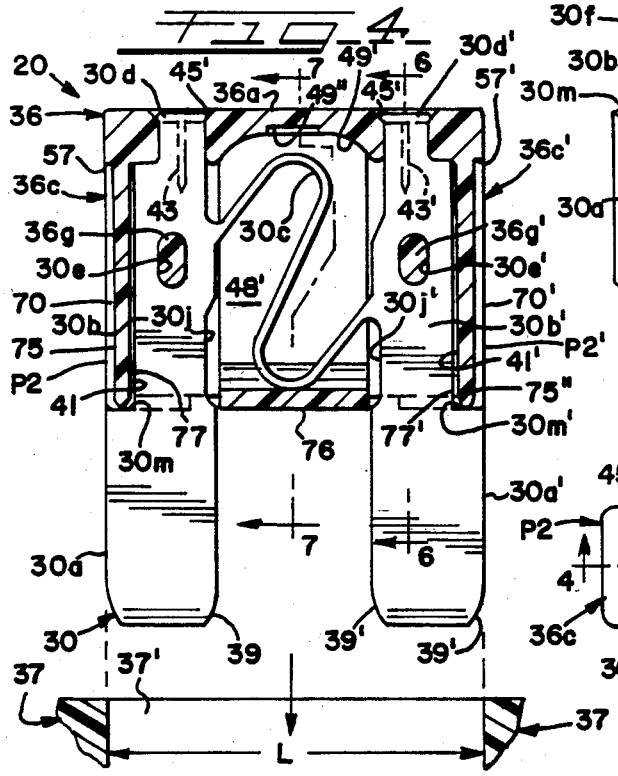
FIG. 4 is a vertical longitudinal sectional view through the plug-in fuse assembly shown in FIG. 3, taken along section line 4—4 therein and includes in fragmentary section the defining walls of a fuse blank cavity into which the fuse assembly is to be placed.

As previously indicated, the unique part of the present invention is the provision of outermost projecting portions in the side walls 36*b*–36*b*' and the end walls 36*c*–36*c*' . They are preferably narrow, inverted U-shaped projections P1–P1' and P2–P2' (FIGS. 1, 6 and 7) extending along the side and top margins of the side and end walls. The outer surfaces of each of these projections is in the same vertical plane parallel to the side of the housing involved. The projections P1 and P1' have vertical legs 60—60 and 60'—60' at each end of the fuse housing, and horizontal legs 62–62' at the top of the housing. The bottom margins of the horizontal legs 62 and 62' define the gripping surfaces 53–53' and 55—55 and 55'—55'. The end wall projections P2–P2' have vertical legs 61—61 and 61'—61' and horizontal legs 63–63' supported by tapered recesses 70–70'. The bottom margins of these horizontal legs 63–63' form horizontal downwardly facing gripping surfaces 57–57' which are in the same plane as the other gripping surfaces 53–53' and 55–55'. To facilitate mold separation, as best shown in FIG. 4, that portion of the housing end walls 36*c*–36*c*' forming the recesses 70–70' have downwardly tapering cross sections formed by downwardly converging opposite wall surfaces 75, 77 and 75', 77'. The vertical legs 60—60 and 60'—60', and 61—61 and 61'—61' of the upper side and end wall projections P1–P1' and P2–P2' merge at the corners of the generally rectangular housing 36 as best shown in FIG. 1.

The overall area of the vertical outer surfaces of the projections P1 and P1' on the side walls is less than half, preferably less than 25%, of the surface area of the side walls 36*b*–36*b*' so that they do not substantially hinder the separation of the lower mold part which forms all but the uppermost portion of the housing from the molded fuse housing. The area of the end wall projections P2–P2' are also a small percentage of the overall surface area of the housing.

Figure 3:
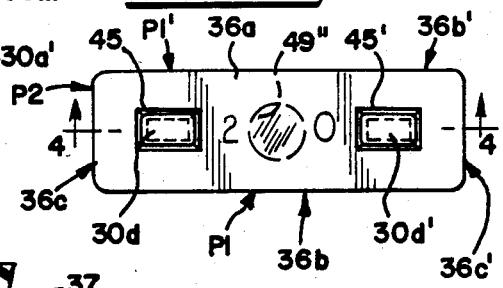
FIG. 3 is a top plan view of the plug-in fuse assembly of FIG. 1.

The outermost vertical flat surfaces of the side and end wall projections P1–P1' and P2–P2' fall along a horizontal rectangle defined by the margins of the top housing wall 36*a* as viewed in FIG. 3. The margins of the fuse block cavity 37' fall along a slightly larger rectangle which facilitates the high speed automated mounting of the fuse assemblies into the fuse block 37.

The housing 36 is initially opened at the bottom thereof so that during assembly of the fuse, the housing can be slipped over the top of the all metal plug-in fuse element 30. The thin gap located between the terminal blade portions 30*a*–30*a*' of the all metal plug-in fuse element 30 is preferably closed by a flap 76 shown in FIG. 7. The flap 76 initially forms an extension of the bulging side wall 40' (FIGS. 2 and 7) and is bent into a recess 78 in the other bulging side wall 40 and is ultrasonically welded to the defining walls thereof or held frictionally thereto by latching barbs (not shown).

It can be seen that when fuses are stacked side-by-side within a hopper 63 (see FIG. 8), adjacent fuses will abut over the mutually parallel, extensively horizontally and vertically distributed vertical surfaces of the projections P1–P1'.

FIGS. 9A and 9B show the end to end stacking of the fuse assemblies in a hopper 63'. The abutting surfaces of the end wall projections P2–P2' provide a stable stacking of the fuses within the hopper 63'.

The fuses are also readily stackable in the manner shown in FIGS. 10A and 10B where the fuse assemblies are shown stacked one on top of the other. In such case, the bottom of each of the terminal blades 30*a* and 30*a*' engages the flat top wall 36*a* of the housing of the fuse therebelow. The positions of the fuse housings are stabilized within the hopper 63'' thereshown because the fuse stacking channels within these hoppers, as is also the case with the hoppers 63 and 63', have the same rectangular shape and size as a rectangle along which the flat outermost vertical surfaces of the projections P1–P1' and P2–P2' extend.

The fuse assemblies can be fed from these hoppers at high speed and automatically inserted into the fuse block cavities 37'. During fuse insertion into a fuse block cavity, the tapered ends of the terminal blades engage the end margins of a rectangular fuse block cavity 37'. The defining walls of this cavity also guide the movement of the similarly shaped and sized fuse housing into its final position where the fuse blades engage the fuse block terminals (not shown). The top of the fuse housing is then still above the level of the fuse block 37 so that the gripping surfaces 53–53' and 55–55' thereof are fully exposed for fuse gripping purposes.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while generally specific claimed details of the invention constitute important specific aspects of the invention, in appropriate instances even the specific claims involved should be construed in light of the Doctrine of Equivalents.

I claim:

1. In a plug-in fuse assembly including a housing made of insulating material and including a pair of upwardly extending side walls; and a conductive plug-in fuse element secured in said housing and having laterally spaced, generally parallel confronting terminals at the bottom thereof projecting downwardly from the bottom of said housing, said terminals having upwardly extending current-carrying extensions, and a fuse link extending between said current-carrying extensions; portions of said current-carrying extensions and said fuse link being confronted by said side walls; the improvement wherein each side wall has outermost vertical coplanar wall surfaces parallel to the corresponding outermost vertical coplanar wall surfaces on the opposite side of the housing, said outermost vertical coplanar wall surfaces being adapted to engage the complementary outermost vertical wall surfaces of an identical plug-in fuse assembly placed with the identical orientation beside it, to provide for a stable side-by-side stacking of numbers of identical plug-in fuse assemblies in a stacking hopper or the like, said outermost vertical coplanar wall surfaces of each side wall occupying less than one half the total outer exposed surface area of the housing side wall involved, the remainder of which are recessed within the vertical plane thereof.

2. In a plug-in fuse assembly including a housing made of insulating material and including a pair of upwardly extending side walls bridged by a pair of upwardly extending end walls; and conductive plug-in fuse element secured in said housing and having laterally spaced, generally parallel confronting terminals at the bottom thereof projecting downwardly from the bottom of said housing, said terminals having upwardly extending current-carrying extensions, and a fuse link extending between said current-carrying extensions; portions of said current-carrying extensions and said fuse link being enclosed by said end and side walls; the improvement wherein at least one of said pairs of walls each has outermost vertical coplanar wall surfaces parallel to the corresponding outermost vertical coplanar wall surfaces on the opposite end or side of the housing, said outermost vertical coplanar wall surfaces being adapted to engage the complementary outermost vertical wall surfaces of an identical plug-in fuse assembly placed with the identical orientation beside it, to provide for a stable stacking of numbers of identical plug-in fuse assemblies in a stacking hopper or the like, said outermost vertical coplanar wall surfaces of each wall of said pair occupying only a fractional part of the total outer exposed area of the wall involved, the remainder of which is recessed within the vertical plane thereof.

3. In a plug-in fuse assembly including a housing made of insulating material and including a pair of upwardly extending side walls bridged by a pair of upwardly extending end walls; and a conductive plug-in fuse element secured in said housing and having laterally spaced, generally parallel confronting terminals at the bottom thereof projecting downwardly from the bottom of said housing, said terminals having upwardly extending current-carrying extensions, and a fuse link extending between said current-carrying extensions; portions of said current-carrying extensions and said fuse link being enclosed by said end and side walls; the improvement wherein each of said side and end walls has outermost vertical coplanar wall surfaces which are parallel to the housing side or end involved and to the corresponding outermost vertical coplanar wall surfaces on the opposite end or side of the housing, said outermost vertical coplanar wall surfaces being adapted to engage the complementary outermost vertical wall surfaces of an identical plug-in fuse assembly placed with the identical end-to-end or side-by-side orientation beside it, to provide for a stable stacking of numbers of identical plug-in fuse assemblies in a stacking hopper or the like, said outermost vertical coplanar wall surfaces of each wall occupying only a fractional part of the total outer exposed surface area of the housing wall involved, the remainder of which is recessed within the vertical plane thereof.

4. The plug-in fuse assembly of claims 1, 2, or 3 wherein said housing is a molded body and the walls forming the recessed portions of said housing walls are tapered to permit the easy separation of the mold parts forming the same.

5. The plug-in fuse assembly of claims 1, 2, or 3 wherein said vertical coplanar wall surfaces occupy only relatively narrow bands at the sides and top of each of the walls involved, the recessed portions of each wall beneath the band at the top thereof forming a downwardly facing gripping surface at least in the central region of the band.

6. The plug-in fuse assembly of claims 1, 2, or 3 wherein said housing is a molded body and the walls forming the recessed portions of said housing walls are tapered to permit the easy separation of the mold parts forming the same, and said vertical coplanar wall surfaces occupying only relatively narrow bands at the sides and top of each of the walls involved, the recessed portions beneath the top thereof forming a downwardly facing gripping surface at least in the central region of the band.

7. The plug-in fuse assembly of claim 1 or 3 wherein most of the walls of said housing are of similar thickness, each of said side walls of said housing having a relatively wide bulging central portion extending for most of the height of the housing and spaced from the fuse link of said conductive plug-in fuse element, said bulging portion joining on each side thereof a deeply recessed side wall portion relatively closely enveloping said current-carrying extensions of said conductive plug-in fuse element, and said outermost vertical coplanar wall surfaces on each side wall including wall surfaces on the outer side of each deeply recessed portion thereof and extending for most of the height of the housing in a vertical plane beyond said bulging portion of the side wall involved.

8. The plug-in fuse assembly of claims 1, 2 or 3 wherein said outermost vertical coplanar wall surfaces of each of said walls having the same occupying narrow bands at least at the vertical margins of the housing.

9. The plug-in fuse assembly of claims 1, 2, or 3 wherein said outermost vertical coplanar wall surfaces of each of said walls having the same being inverted U-shaped projections.

10. The plug-in fuse assembly of claim 3 wherein said housing has a generally rectangular horizontal cross section, said vertical coplanar wall surfaces occupy only relatively narrow bands at least at the sides of each wall involved, and said bands of the coplanar wall surfaces merge at the corners of the housing.

11. The plug-in fuse assembly of claim 2 or 3 wherein the outermost vertical surfaces of the terminals have tapered outer margins and are in vertical alignment with said outermost vertical surfaces of said housing end walls, so that these tapered margins can guide the fuse assembly into a rectangular fuse holder cavity of slightly greater size than a rectangle along which said outermost vertical surfaces of said housing walls fall.

12. The plug-in fuse assembly of claim 11 combined with a fuse block having said rectangular cavity in which said fuse assembly is mounted.

13. The plug-in fuse assembly of claim 3 combined with a fuse holder having a rectangular fuse assembly-receiving cavity of slightly greater size than a rectangle along which said outermost vertical surfaces of said housing walls fall, the outermost vertical surfaces of the terminals have tapered outer margins and are in vertical alignment with said outermost vertical surfaces of said housing end walls so that the tapered margins can guide the fuse assembly into a rectangular fuse holder cavity.

14. The combination of claim 13 wherein the upper portion of said housing extends above the fuse holder and is provided with downwardly facing gripping surfaces exposed above said fuse holder.

* * * * *